US007421967B1

(12) United States Patent
Fontenot et al.

(10) Patent No.: US 7,421,967 B1
(45) Date of Patent: Sep. 9, 2008

(54) MOORING APPARATUS AND METHOD

(75) Inventors: William L. Fontenot, Houston, TX (US); Yonghui Liu, Houston, TX (US); Stephen P. Lindblade, Waller, TX (US); Brent A. Salyer, Cypress, TX (US)

(73) Assignee: SOFEC, Inc., Houston, TX (US)

( * ) Notice: Subject to any disclaimer, the term of this patent is extended or adjusted under 35 U.S.C. 154(b) by 0 days.

(21) Appl. No.: 11/728,245

(22) Filed: Mar. 23, 2007

(51) Int. Cl.
*B63B 21/00* (2006.01)

(52) U.S. Cl. ..... 114/230.24; 114/200; 114/293

(58) Field of Classification Search ..... 114/200, 114/230.1, 230.12, 230.24, 293; 441/3, 4, 441/5; 24/116 R
See application file for complete search history.

(56) References Cited

U.S. PATENT DOCUMENTS 3,289,626 A * 12/1966 Petrie et al. ..... 114/200
4,186,464 A * 2/1980 Sandoy ..... 24/116 R
4,889,065 A * 12/1989 van den Haak ..... 114/293
5,097,787 A * 3/1992 Bruce ..... 114/293
5,934,216 A * 8/1999 Childers et al. ..... 114/230.1
6,044,787 A 4/2000 Elmbo
6,070,548 A * 6/2000 Ducousso et al. ..... 114/293
6,314,901 B1 11/2001 Smedal
6,983,714 B2 * 1/2006 Dove et al. ..... 114/293

* cited by examiner

*Primary Examiner*—Lars A Olson
(74) *Attorney, Agent, or Firm*—Henry C. Query, Jr.

(57) ABSTRACT

A mooring system for securing a floating vessel to the sea floor comprises a plurality of mooring legs, at least one of which includes separate first and second mooring lines. The first mooring line comprises a first end which is connected to the vessel and the second mooring line comprises a first end which is secured to the sea floor. The mooring system also comprises a connection and tensioning device which includes a body, a bore which extends through the body, a chain stopper for adjustably securing the first mooring line to the body, and a connector for connecting a second end of the second mooring line to the body. In use, a second end of the first mooring line is inserted into the bore and the first mooring line is pulled through the bore while the body is subject to an opposing pulling force. Once the first mooring line is pulled through the bore a desired distance, the chain stopper maintains the first mooring line in position relative to the body to thereby secure the vessel to the sea floor.

8 Claims, 4 Drawing Sheets

MOORING APPARATUS AND METHOD

BACKGROUND OF THE INVENTION

The present invention relates to a system and method for mooring a floating vessel to the sea floor. More particularly, the invention relates to a system and method in which two separate sections of a mooring leg, one of which is connected to the vessel and the other of which is secured to the sea floor, are joined together by a connection and tensioning device and the mooring leg is adjusted to a desired length by cross-pulling one of the sections through the tensioning device.

A prior art mooring system for a floating production, storage and offloading ("FPSO") vessel is shown in FIG. 1. This mooring system, which is commonly referred to as a direct-connect mooring system, includes a number of mooring legs M which are connected between the FPSO's turret and an anchoring device which is embedded in the sea floor, such as a pile.

Once the mooring legs are connected to the FPSO, they must be tensioned to the desired length. In certain prior art mooring systems, this is accomplished by pulling the proximal ends of the mooring legs through corresponding chain stoppers on the turret using a heavy-duty winch on the FPSO. However the chain stoppers and heavy-duty winch add cost and complexity to the FPSO.

In the direct-connect mooring system illustrated in FIG. 1, each mooring leg is tensioned by first cutting it to a desired length and then connecting it to a short chain section which has previously been attached to a corresponding universal joint on the turret. When the FPSO is installed in deep water, each mooring leg comprises a relatively long vertical run. Consequently, the force required to connect the mooring leg to its corresponding chain section is manageable. However, in shallower waters the mooring legs comprise relatively short vertical runs. Consequently, more force must be used to connect the mooring lines to the FPSO. Depending on the depth of the water, therefore, this connecting force may become unmanageable.

SUMMARY OF THE INVENTION

In accordance with the present invention, these and other disadvantages with the prior art are overcome by providing a mooring system for securing a floating vessel to the sea floor. The mooring system includes a plurality of mooring legs, at least one of which comprises separate first and second mooring lines. One of the first and second mooring lines comprises a first end which is connected to the vessel and the other of the first and second mooring lines comprises a first end which is secured to the sea floor. The mooring system also comprises a connection and tensioning device which includes a body, a bore which extends through the body, means for adjustably securing the first mooring line to the body, and means for connecting a second end of the second mooring line to the body. In use of the mooring system, a second end of the first mooring line is inserted into the bore and the first mooring line is pulled through the bore while the body is subject to an opposing pulling force. Once the first mooring line is pulled through the bore a desired distance, the adjustable securing means maintains the first mooring line in position relative to the body to thereby secure the vessel to the sea floor.

In one embodiment of the invention, the mooring system further comprises a first pull line which is connected to a second end of the first mooring line, a second pull line which is connected to the body, a first pulling vessel to which the first pull line is connected, and a second pulling vessel to which the second pull line is connected. In use of the mooring system of this embodiment, the second end of the first mooring line is inserted into the bore and the first mooring line is pulled through the bore by the first pulling vessel while the body is pulled in an opposing direction by the second pulling vessel. Once the first mooring line is pulled through the bore a desired distance, the adjustable securing means maintains the first mooring line in position relative to the body to thereby secure the vessel to the sea floor.

The present invention also provides method for securing an object to the sea floor. The method comprises the steps of providing at least one mooring leg which comprises separate first and second mooring lines, connecting a first end of one of the first and second mooring lines to the object, securing a first end of the other of the first and second mooring lines to the sea floor, providing a connection and tensioning device which includes a body and a bore which extends through the body, inserting a second end of the first mooring line into the bore, connecting a second end of the second mooring line to the body, pulling the first mooring line through the bore while subjecting the body to an opposing pulling force, and securing the first mooring line to the body to thereby secure the object to the sea floor.

In accordance with one aspect of this invention, the method for securing the vessel to the sea floor also comprises the steps of connecting a first pull line to the second end of the first mooring line and connecting a second pull line to the body. Accordingly, the step of pulling the first mooring line through the bore comprises pulling the first pull line, and the step of subjecting the body to an opposing pulling force comprises pulling the second pull line. In accordance with another aspect of the invention, the steps of pulling the first and second pull lines are performed by respective first and second pulling vessels.

Thus, the present invention provides a efficient and convenient system and method for mooring an object to the sea floor. The invention is particularly useful in mooring objects in relatively shallow water. Since the mooring leg comprising the first and second mooring lines is first connected between the vessel and the sea floor, the need to connect the mooring leg to the vessel after the mooring leg has been cut to length is obviated. Furthermore, since the mooring leg is adjusted to its desired length by cross-tensioning the first mooring line through the connection and tensioning device, the force required to tension the mooring leg to the desired length is relatively low.

These and other objects and advantages of the present invention will be made apparent from the following detailed description, with reference to the accompanying drawings.

DETAILED DESCRIPTION OF THE INVENTION

The mooring apparatus and method of the present invention may be used to anchor a variety of vessels and other objects to the sea floor. In addition, the mooring apparatus and method may employ any number of mooring legs, and these mooring legs may be arranged in any desired or required configuration about the vessel. For purposes of brevity, however, the present invention will be described in the context of an exemplary 3 by 3 mooring system for an FPSO.

Figure 1:
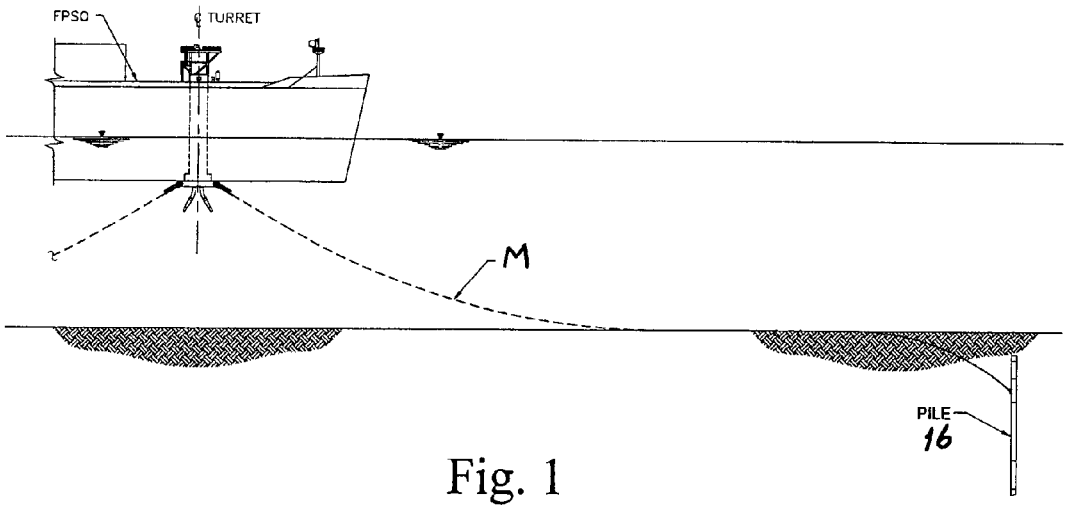
FIG. 1 is a representation of a prior art arrangement for mooring a vessel to the sea floor.
Figure 2:
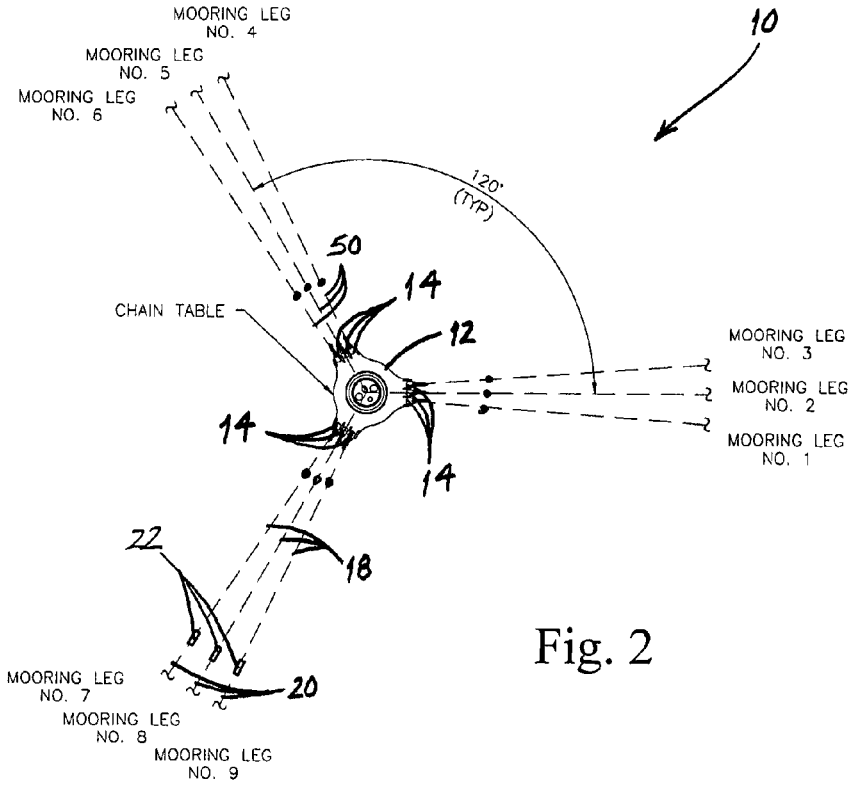
FIG. 2 is a plan view of an exemplary 3 by 3 mooring system of the present invention, in which the vessel has been omitted for purposes of clarity.

Referring to FIG. 2, the exemplary 3 by 3 mooring system of the present invention, which is indicated generally by reference number 10, comprises nine mooring legs 1-9 arranged in groups of three spaced about 120° apart. Each of the mooring legs 1-6 may comprise a conventional length of chain, or wire or adjoining lengths of chain and wire, and each comprises a first end which is connected to the vessel's chain table 12 by suitable means, such as a universal joint 14, and a second end which is connected to a device which is embedded in the sea floor, such as a drag anchor or, as shown in FIG. 1, a pile 16.

In contrast to the mooring legs 1-6, each of the mooring legs 7-9 comprises two separate lengths of mooring line 18, 20 which are connected together by the connection and tensioning device of the present invention, which is indicated generally by reference number 22. Each of the first mooring lines 18 comprises a first end which is connected to the chain table 12 such as by a corresponding universal joint 14 and a second end which is secured to the chain connection and tensioning device 22 in a manner which will be discussed below. Similarly, each of the second mooring lines 20 comprises a first end which is connected to, e.g., a corresponding pile 16 and a second end which is secured to the connection and tensioning device 22 in a manner which will be described below. As with the mooring legs 1-6, each of the mooring lines 18, 20 may comprise a continuous length of chain or wire or adjoining lengths of chain and wire.

Figure 3:
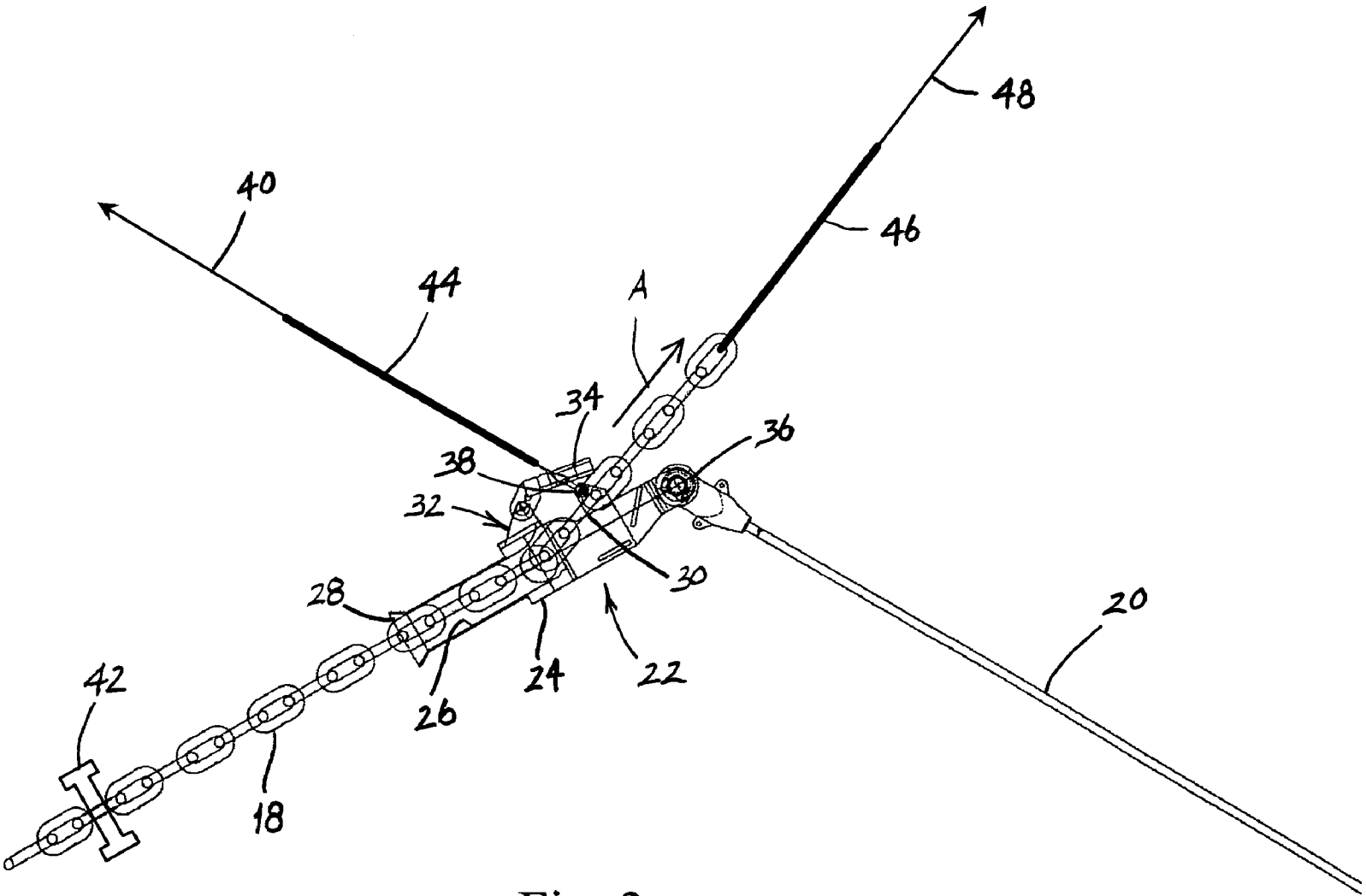
FIG. 3 is a representation of one embodiment of the connection and tensioning device of the present invention.

Referring now to FIG. 3, an example of the connection and tensioning device 22 is shown which is particularly suitable for use with an embodiment of the mooring system 10 in which at least one of the mooring lines 18, 20 of each mooring leg 7-9 comprises a length of chain. In this exemplary embodiment, each first mooring line 18 comprises a length of studless chain and each second mooring line 20 comprises a length of spiral strand ground wire. However, the person of ordinary skill in the art will readily understand how to adapt the teachings of the present invention to enable the connection and tensioning device 22 to be used with other types of mooring lines.

As shown in FIG. 3, the connection and tensioning device 22 comprises a generally elongated body 24, a bore 26 which extends generally axially through the body between a first port 28 and a second port 30, and means 32 for adjustably securing a mooring line, such as the first mooring line 18, to the body. In one embodiment of the invention, the adjustable securing means 32 comprises a conventional chain stopper which includes a pawl 34 that is pivotably connected to the body over the second port 30. As is known in the art, the pawl 34 enables the first mooring line 18 to be pulled through the bore 26 in the direction of the arrow A, but prevents the mooring line from being pulled through the bore in the opposite direction.

The connection and tensioning device 22 further comprises first means 36 for fixedly connecting the body 24 to a first line, such as the second mooring line 20, and second means 38 for fixedly connecting the body to a second line, such as a pull line 40. In the embodiment of the invention shown in FIG. 3, the first fixed connecting means 36 comprises a pin joint and the second fixed connecting means 38 comprises a pad eye, although other suitable connectors may also be used.

One method for mooring a vessel in accordance with the present invention will now be described with reference to FIGS. 2 through 6, in which for purposes of explanation the vessel will be assumed to be moored in 50 meters of water. In this example, the mooring legs 1-6 may comprise 500 meters of ø90 spiral strand ground wire connected to 350 meters of ø4.5 inch studless chain. In addition, the first mooring line 18 of each mooring leg 7-9 may comprise about 390 meters of ø4.5 inch studless chain, and the second mooring line 20 of each mooring leg 7-9 may comprise 500 meters of ø90 spiral strand around wire.

Figure 4:
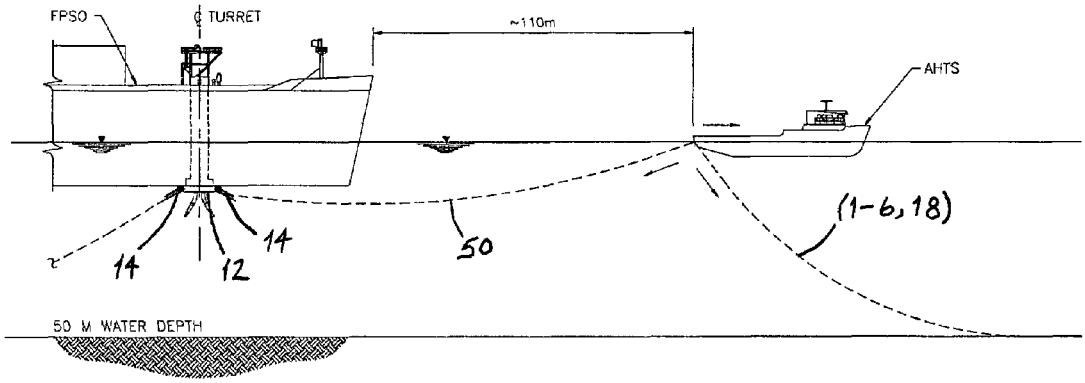
FIGS. 4 through 6 are representations of a method of mooring a vessel in accordance with one embodiment of the present invention.
Figure 5:
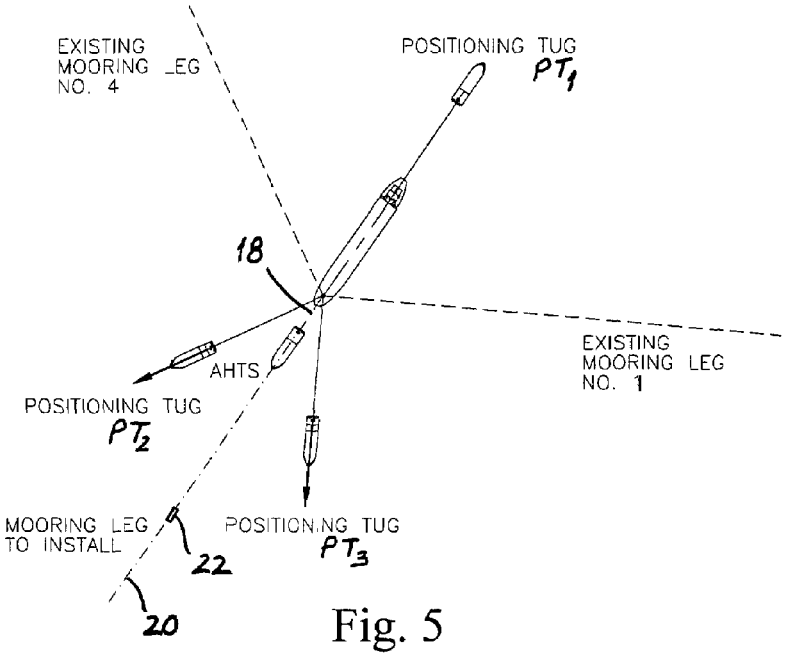
Figure 6:
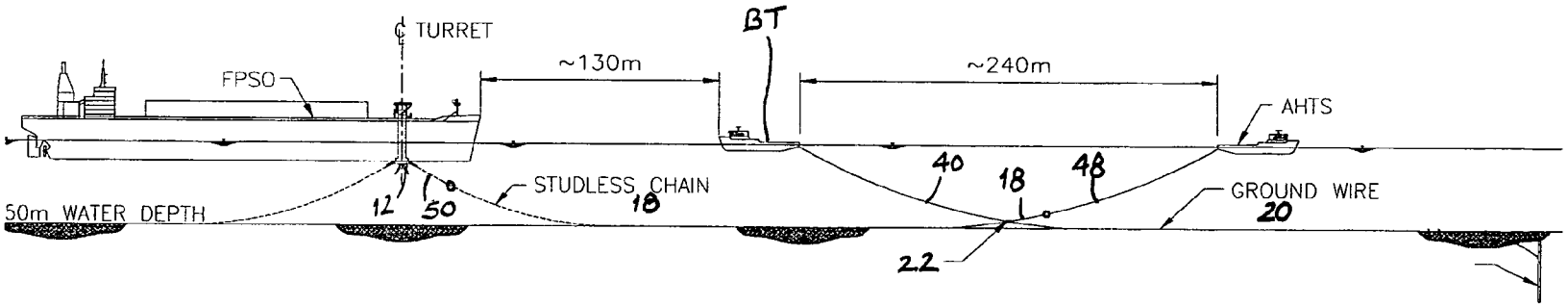

Several tugs are preferably used to carry out the exemplary mooring procedure of the present invention. Referring to FIGS. 4 through 6, for example, three positioning tugs $PT_1$-$PT_3$ may be used to hold the FPSO on station during the mooring operation. In this example, two of these positioning tugs should be capable of 100 metric-tons sustained bollard pull. In addition, one AHTS capable of 100 metric-tons sustained bollard pull and equipped with low rotation winch rope and a remotely operated vehicle ("ROV"), together with one back-tensioning tug BT, may be used to perform the cross tensioning operation described below. In this regard, one of the positioning tugs $PT_1$-$PT_3$ may serve as the back-tensioning tug BT.

As a first step in the exemplary mooring method of the present invention, the mooring legs 7-9 are made up by connecting the second end of each second mooring line 20 to the first fixed connecting means 36 of a respective connection and tensioning device 22, and then pulling the second end of the corresponding first mooring line 18 through the bore 26 of the device. The first ends of the second mooring lines 20 and the distal ends of the remaining mooring legs 1-6 are then connected to corresponding piles 16 which are embedded in the sea floor in a conventional manner.

Referring to FIG. 4, an ROV (not shown) is used to connect a low rotation winch rope (not shown) to the proximal end of mooring leg 1 so that it can be pulled on board the AHTS. Mooring leg 1 is then cut to the desired length and connected to a short chain section 50 which has previously been connected to a corresponding universal joint 14 on the vessel's chain table 12. This same procedure is then repeated to connect mooring leg 4 to the vessel.

Mooring leg 7 is now ready to be connected to the vessel. Referring to FIG. 5, preferably two positioning tugs $PT_2$ and $PT_3$ are used to pull the vessel in the direction of mooring leg 7 with a force of approximately 150 metric-tons, which is required to overcome the pull from mooring legs 1 and 4 The ROV is then used to connect a low rotation winch rope to the first end of the mooring line 18 so that it can be pulled on board the AHTS. The first end of the first mooring line 18 is then connected to a corresponding chain section 50 which has previously been connected to a corresponding universal joint 14 on the vessel's chain table 12. The vessel is now storm-safe up to approximately one-year storm conditions.

Once mooring leg 7 is connected to the vessel, mooring legs 2, 3, 5 and 6 are connected to the vessel in turn using the same procedures for connecting mooring legs 1 and 4 to the vessel.

Mooring leg 7 may now be cross tensioned to its desired length. Prior to doing so, however, an over-pull shackle 42 is installed in the first mooring line 18 at a position which will prevent over pulling once mooring leg 7 has reached its final length. Also, a first retrieval loop 44 to which the pull line 40 will be connected is attached to the second fixed connection means 38 on the connection and tensioning device 22. Finally, a second retrieval loop 46 to which a second pull line 48 will be connected is attached to the second end of the first mooring line 18.

Once these preparations are completed, the ROV is used to attach the first pull line 40, which is connected to the back-tensioning tug BT, to the first retrieval loop 44, and the back-tensioning tug is operated to lift the connection and tensioning device 22 off of the sea floor. The ROV is then used to attach the second pull line 48, which is connected to the AHTS, to the second retrieval loop 46.

Referring to FIG. 6, the back-tensioning tug BT and the AHTS then work together to tension mooring leg 7 to the desired length. The AHTS pulls the first mooring line 18 through the connection and tensioning device 22 in the direction of its corresponding pile 16 until the over-pull shackle 42 engages the body 24. This procedure generally requires that the AHTS apply a horizontal force of approximately 70 metric-tons. The back-tensioning tug BT simultaneously pulls the first pull line 40 in the direction of the vessel. Once mooring leg 7 is cross tensioned to the desired length, the excess chain at the free end of the mooring line 18 is laid on the sea floor and the first and second pull lines 40, 48 are released.

After mooring leg 7 is adjusted to the desired length, mooring leg 8 is connected and cross tensioned to the desired length using the same method as described above for mooring leg 7. In this regard, the cross tensioning procedure generally requires that the AHTS apply a horizontal force of approximately 60 metric-tons to the first mooring line 18 in order to adjust mooring leg 8 to the proper length.

After mooring leg 8 is adjusted to the desired length, mooring leg 9 is connected and cross tensioned to the desired length using the same method as described above for mooring legs 7 and 8. In this regard, the cross tensioning procedure generally requires that the AHTS apply a horizontal force of approximately 35 metric-tons to the first mooring line 18 in order to adjust mooring leg 9 to the proper length.

Figure 7:
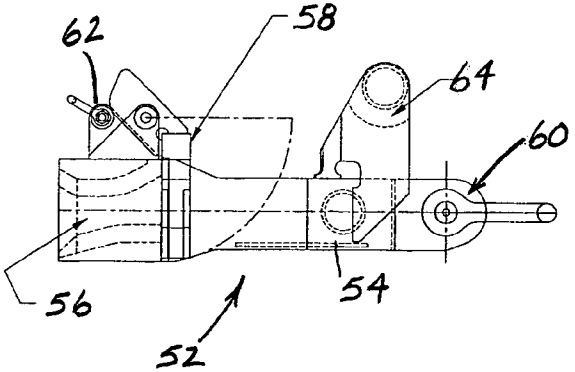
FIG. 7 is a representation of a second embodiment of the connection and tensioning device of the present invention.

A second embodiment of the connection and tensioning device of the present invention is illustrated in FIG. 7. The connection and tensioning device of this embodiment, which is indicated generally by reference number 52, comprises a body 54, a cruciform-shaped bore 56 which extends through the body and through which the second end of the first mooring line 18 is inserted, means such as a chain stopper 58 for adjustably securing the first mooring line to the body, first means, such as a pin joint 60, for connecting the second end of the second mooring line 20 to the body, and second means, such as a pad eye 62, for connecting the first pull line 40 to the body. The connection and tensioning device 52 may also comprise a chain alignment guide 64 for maintaining the first mooring line 18 aligned with the body 54 during the cross-tensioning operation.

The system and method of the present invention may also be used to connect other objects to the sea floor. One such object may be, for example, a buoy to which a floating vessel is moored. In this case, the first end of the first mooring line is connected to the buoy, the first end of the second mooring line is connected to an anchoring device which is embedded in the sea floor, and the second ends of the first and second mooring lines are connected and cross tensioned using the connection and tensioning device described above.

It should be recognized that, while the present invention has been described in relation to specific embodiments thereof, those skilled in the art may develop a wide variation of structural and operational details without departing from the principles of the invention. Therefore, the appended claims are to be construed to cover all equivalents falling within the true scope and spirit of the invention.

What is claimed is:

1. A mooring system for securing a floating vessel to a sea floor, the mooring system comprising:

a plurality of mooring legs, at least one of which comprises separate first and second mooring lines;

wherein one of the first and second mooring lines comprises a first end which is connected to the vessel and the other of the first and second mooring lines comprises a first end which is secured to the sea floor;

a connection and tensioning device which includes:

a body;

a bore which extends through the body;

means for adjustably securing the first mooring line to the body; and means for connecting a second end of the second mooring line to the body;

wherein in use a second end of the first mooring line is inserted into the bore and the first mooring line is pulled through the bore while the body is subject to an opposing pulling force;

wherein once the first mooring line is pulled through the bore a desired distance, the adjustable securing means maintains the first mooring line in position relative to the body to thereby secure the vessel to the sea floor;

a first pull line which is connected to the second end of the first mooring line;

a first pulling vessel to which the first pull line is connected;

wherein the first mooring line is pulled through the bore by the first pulling vessel;

means for generating the opposing pulling force;

a second pull line which is connected to the body; and a second pulling vessel to which the second pull line is connected;

wherein the opposing pulling force is exerted by the second pulling vessel.

2. The mooring system of claim 1, wherein the adjustable securing means comprises a chain stopper which is connected to or formed integrally with the body.

3. A mooring system for securing an object to a sea floor, the mooring system comprising:

at least one mooring leg which comprises separate first and second mooring lines;

wherein one of the first and second mooring lines comprises a first end which is connected to the object and the other of the first and second mooring lines comprises a first end which is secured to the sea floor;

a connection and tensioning device which includes:

a body;

a bore which extends through the body;

means for adjustably securing the first mooring line to the body; and means for fixedly connecting a second end of the second mooring line to the body;

a first pull line which is connected to a second end of the first mooring line;

a second pull line which is connected to the body;

a first pulling vessel to which the first pull line is connected; and a second pulling vessel to which the second pull line is connected;

wherein in use the second end of the first mooring line is inserted into the bore and the first mooring line is pulled through the bore by the first pulling vessel while the body is pulled in an opposing direction by the second pulling vessel; and wherein once the first mooring line is pulled through the bore a desired distance, the adjustable securing means maintains the first mooring line in position relative to the body to thereby secure the object to the sea floor.

4. The mooring system of claim 3, wherein the adjustable securing means comprises a chain stopper which is connected to or formed integrally with the body.

5. A method for securing an object to a sea floor, the method comprising:

providing at least one mooring leg which comprises separate first and second mooring lines;

connecting a first end of one of the first and second mooring lines to the object;

securing a first end of the other of the first and second mooring lines to the sea floor;

providing a connection and tensioning device which includes a body and a bore which extends through the body;

inserting a second end of the first mooring line into the bore;

connecting a second end of the second mooring line to the body;

pulling the first mooring line through the bore while subjecting the body to an opposing pulling force;

securing the first mooring line to the body to thereby secure the object to the sea floor;

connecting a first pull line to the second end of the first mooring line; and connecting a second pull line to the body;

wherein the step of pulling the first mooring line through the bore comprises pulling the first pull line; and wherein the step of subjecting the body to an opposing pulling force comprises pulling the second pull line.

6. The method of claim 5, further comprising:

connecting the first pull line to a first pulling vessel; and connecting the second pull line to a second pulling vessel;

wherein the step of pulling the first pull line is performed by the first pulling vessel; and wherein the step of pulling the second pull line is performed by the second pulling vessel.

7. The method of claim 6, further comprising:

disconnecting the first pull line from the first mooring line.

8. The method of claim 6, further comprising:

disconnecting the second pull line from the body.

* * * * *